United States Patent [19]

Whitley et al.

[11] 4,223,828

[45] Sep. 23, 1980

[54] MAILBOX WITH IMPROVED DOOR OPENING MEANS AND FLAG OPERATOR

[76] Inventors: John A. Whitley, 203 Randolph Ave.; Lacy A. Rowe, 1851 Skycoe Dr., both of Salem, Va. 24153

[21] Appl. No.: 26,307

[22] Filed: Apr. 2, 1979

[51] Int. Cl.[2] ..... B65D 91/00

[52] U.S. Cl. ..... 232/45; 232/17; 232/35

[58] Field of Search ..... 232/17, 35, 38, 39, 232/45

[56] References Cited

U.S. PATENT DOCUMENTS

| | | | |
|---|---|---|---|
| 761,938 | 6/1904 | Bevan | 232/35 |
| 1,194,593 | 8/1916 | Boland | 232/45 |
| 1,292,050 | 1/1919 | Raney | 232/35 |
| 1,456,543 | 5/1923 | Feist | 232/35 |
| 1,792,821 | 2/1931 | Cook | 232/17 |
| 2,834,540 | 5/1958 | Hudgins | 232/45 |
| 3,294,057 | 12/1966 | Feil | 232/35 X |
| 3,733,026 | 5/1973 | Rowe et al. | 232/35 |

*Primary Examiner*—Roy D. Frazier
*Assistant Examiner*—Peter A. Aschenbrenner

[57] ABSTRACT

A roadside mailbox is adapted to be opened and closed by movement of a mail service vehicle past it. The box has a door hinged along its bottom edge to the bottom of the mailbox. A lever arm, which is made of spring wire, projects outwardly from the door and is engageable by a slanted actuating rod mounted on the vehicle. As the vehicle approaches the box, engagement of the actuating rod with the arm opens the mailbox. As the vehicle leaves the box, the rod becomes disengaged from the arm and the door is closed by a spring. The lever arm resists bending in a vertical plane, and has substantially greater flexibility to bend in a horizontal plane toward and away from the mailbox. The actuating rod includes telescoping sections and may be quickly detached from its support on the side of the vehicle. A signal flag on the box, if raised is automatically lowered by opening the door. The signal flag may also be manually raised and lowered even with the door closed.

18 Claims, 8 Drawing Figures

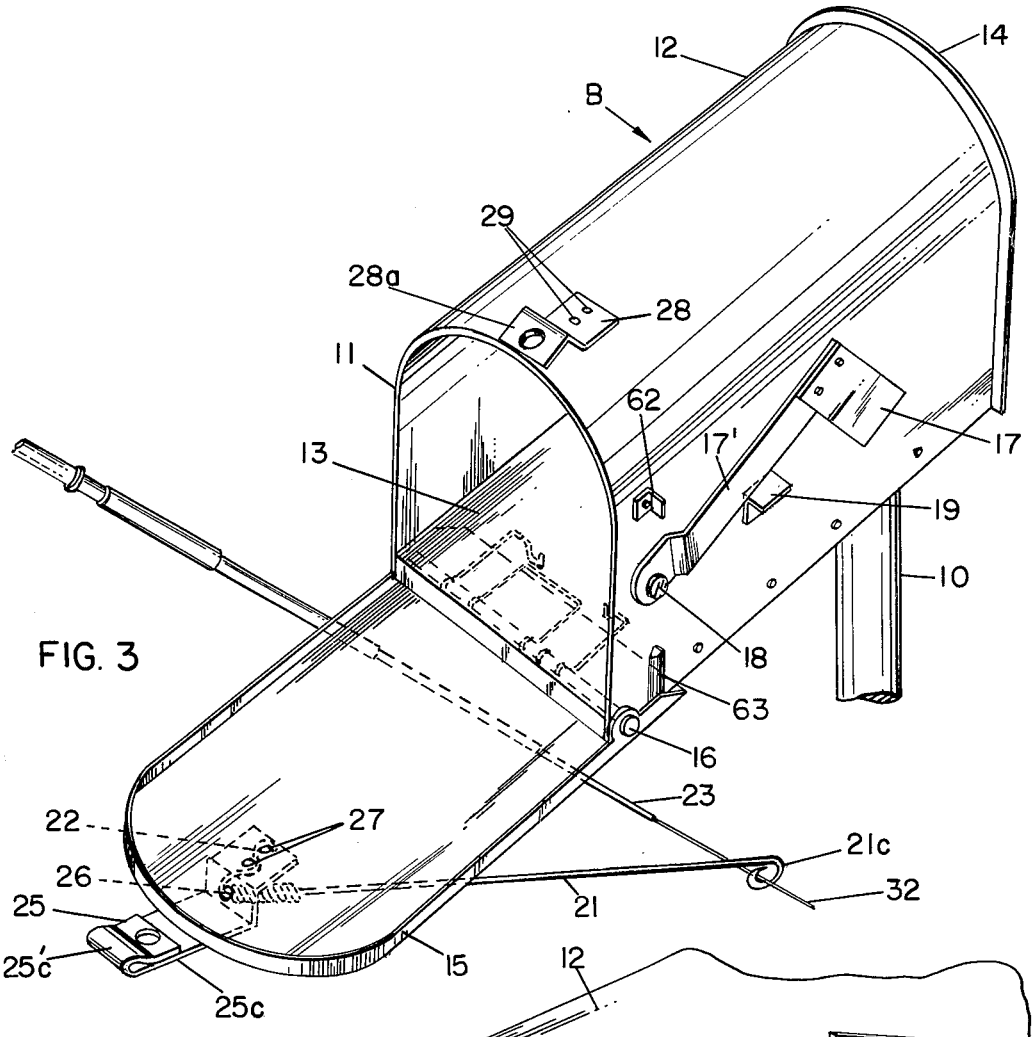
FIG. 3
FIG. 4
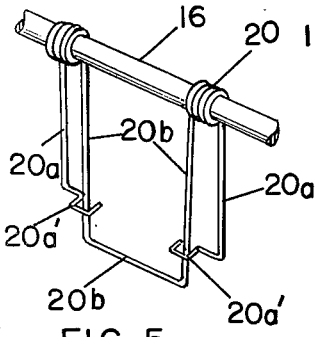
FIG. 5
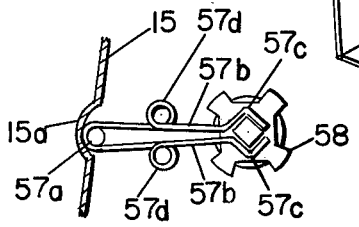
FIG. 6
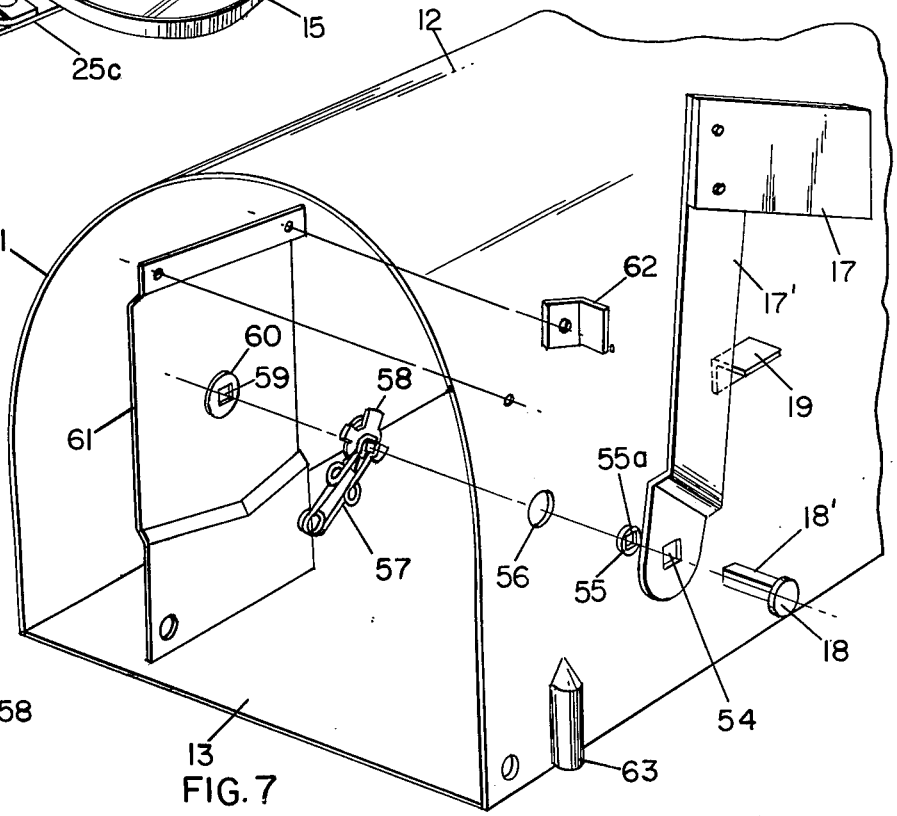
FIG. 7

MAILBOX WITH IMPROVED DOOR OPENING MEANS AND FLAG OPERATOR

BACKGROUND OF THE INVENTION

1. Field of the Invention.

This invention relates to new and useful improvements in rural mailboxes which are usually located at the side of a road and are serviced by a mailman who travels by automobile or truck from one box to the next. The boxes have a downwardly swingable door which the mailman has to open in order to place mail into the box and/or remove mail therefrom, and when this has been accomplished the mailman has to close the door. Also, many such boxes have a signal flag which, when raised, notifies the mailman that there is mail in the box to be picked up, and after doing so, the mailman has to lower the flag.

2. Description of the Prior Art.

Our prior U.S. Pat. No. 3,733,026 issued May 15, 1973 discloses a mailbox and servicing apparatus mounted upon a postal service vehicle which greatly expedites the mailbox servicing procedure by the provision of means whereby the mailbox door is automatically opened as the mail service vehicle approaches the box, and the signal flag, if raised, is automatically lowered by opening of the door. Then, as the vehicle leaves the box, the door is automatically closed.

The apparatus disclosed in our U.S. Pat. No. 3,733,026 includes a mailbox having an arm projecting outwardly from the mailbox door, the arm being engageable by a slanted actuating rod mounted on the postal service vehicle so that the door is opened when the vehicle arrives at the box. As the vehicle leaves, the actuating rod is disengaged from the arm and the box door is closed by a spring. A linkage between the door and the signal flag automatically lowers the flag, if raised, as a function of opening of the door.

The arm on the mailbox door disclosed in U.S. Pat. No. 3,733,026 is relatively rigid, and therefore it presents the possibility of injury to a person or object passing along the road into the path of the arm. Also the actuating rod which is supported on the postal service vehicle extends outwardly from the side of the vehicle and in doing so, it is possible to inflict injury to a person or object which the rod might encounter. The linkage between the door of the mailbox and the signal flag is located outside of the mailbox where it is exposed to the weather. This is a disadvantage when icy conditions occur because the linkage may become inoperable because of ice.

SUMMARY OF THE INVENTION

It is an important object of the present invention to provide improvements over the apparatus disclosed in our U.S. Pat. No. 3,733,026 whereby the apparatus can be used with greater safety without the risk of injury to individuals or damage to objects encountered thereby. In order to accomplish the aforesaid object, a new lever arm for the mailbox door has been provided which is made of spring wire. The new arm has substantial resistance to bending in a vertical plane and is substantially more flexible to bend horizontally toward and away from the mailbox. Also a new actuating rod and new means for mounting the actuating rod on a postal service vehicle has been provided. The mounting means is provided with hinged joints which permit the actuating rod to collapse toward the side of the vehicle when an object is encountered. However, the joints are designed to resist yielding unless an excessive force greater than the force required to open the mailbox door is applied to the actuating rod.

It is a further object of this invention to provide an actuating rod which is telescopic from an extended to a shortened length in order to place the rod in a non-use condition.

It is a further object of this invention to provide an actuating rod which may be quickly disconnected from its mounting means and to provide mounting means with quickly separable components and which may be quickly removed in its entirety from the postal service vehicle.

It is a further object of this invention to provide a spring bias means for closing the mailbox door which may be latched in an inactive condition to remove the bias from the door.

It is a further object of this invention to provide a pawl connection between a signal flag and the mailbox door which is enclosed within the mailbox out of the weather.

It is a further object of this invention to provide the signal flag with a yieldable spring pawl which permits the signal flag to be raised and lowered manually even when the mailbox door is closed, but which when the flag is raised normally holds the flag in raised position until the door is opened, whereupon the flag falls by gravity to its lowered position, or until an operator grasps the flag and manually manipulates the flag to its lowered position.

With the foregoing more important objects and features in view and such other objects and features which may become apparent as this specification proceeds, the invention will be understood from the following description taken in conjunction with the accompanying drawings, in which like characters of reference are used to designate like parts, and in which:

FIG. 3 is a perspective view similar to that in FIG. 1, but showing the mailbox open;

FIG. 4 is an enlarged sectional detail of the actuating rod, taken substantially in the plane of the line 4—4 in FIG. 2;

FIG. 5 is an enlarged perspective view of the mailbox door biasing spring and a portion of the door hinge pin;

FIG. 6 is a fragmentary vertical sectional view of a portion of the mailbox door in its closed position showing the spring linkage attached to the mailbox signal flag pivot pin engaged with a detent in the door surface for holding the signal flag upright when the door is closed;

FIG. 7 is an exploded perspective view of the open mailbox and the signal flag with its associated parts;

Figure 1:
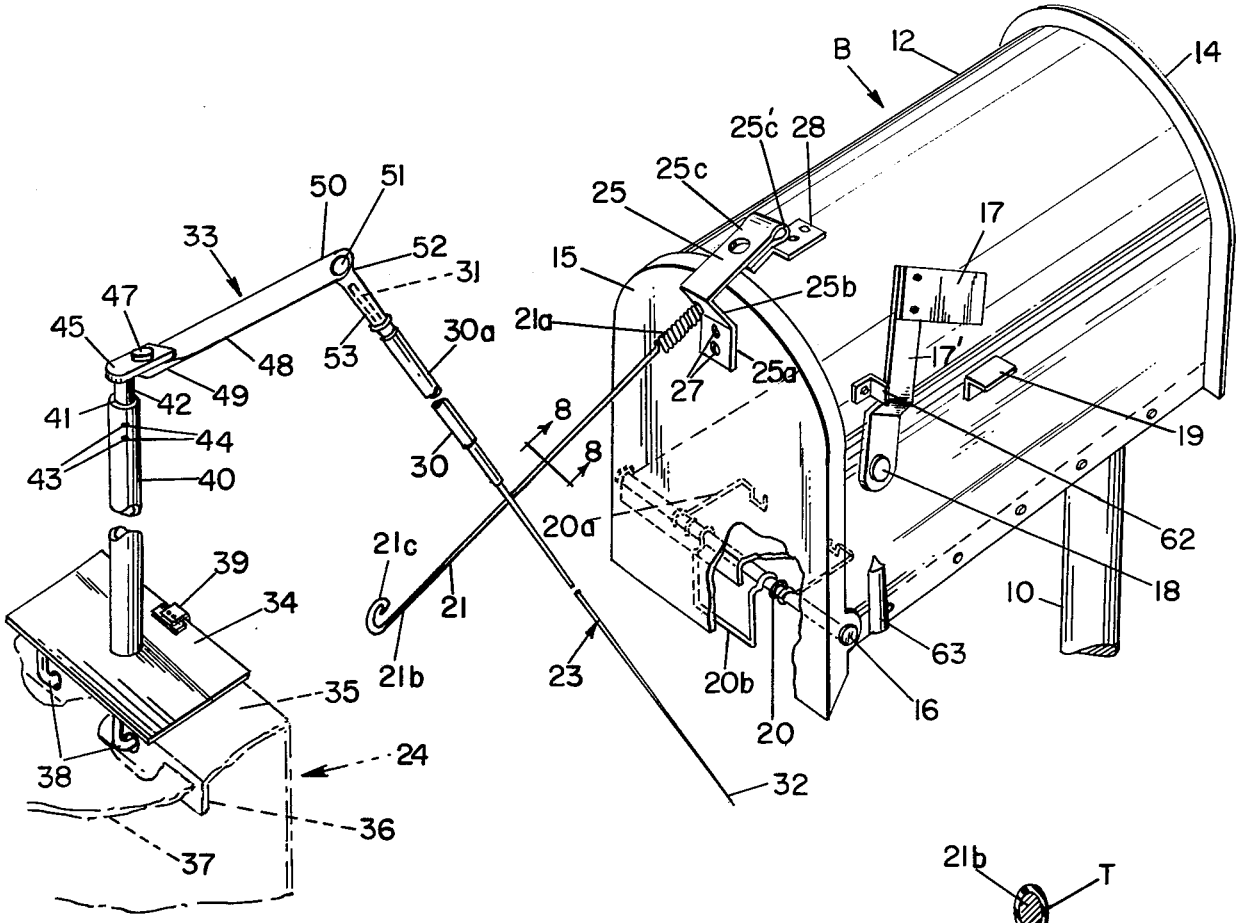
FIG. 1 is a perspective view of a mailbox in accordance with the invention, also showing a cooperating actuating rod mounted on a vehicle shown by dotted lines, the box being in its closed position.

Referring now to the accompanying drawings, the reference character B generally designates a rural mailbox mounted on a supporting post 10 at one side of a road. For the most part, the box is of a conventional construction, including a body 12 of an inverted U-shaped cross-section, with a floor or bottom 13 and a closed end 14. The end of the box body facing the road is open and provided with a door 15, the latter being mounted by a horizontal hinge pin 16 for movement between a closed position shown in FIGS. 1–2 and an open position shown in FIG. 3. A signal flag 17 is pivotally mounted as at 18 at one side of the body 12, the flag being movable between a raised position shown in FIG. 1 and a lowered position shown in FIG. 3. In the latter position, the flag rests against a stop bracket 19 secured to the side of the box.

Figure 2:
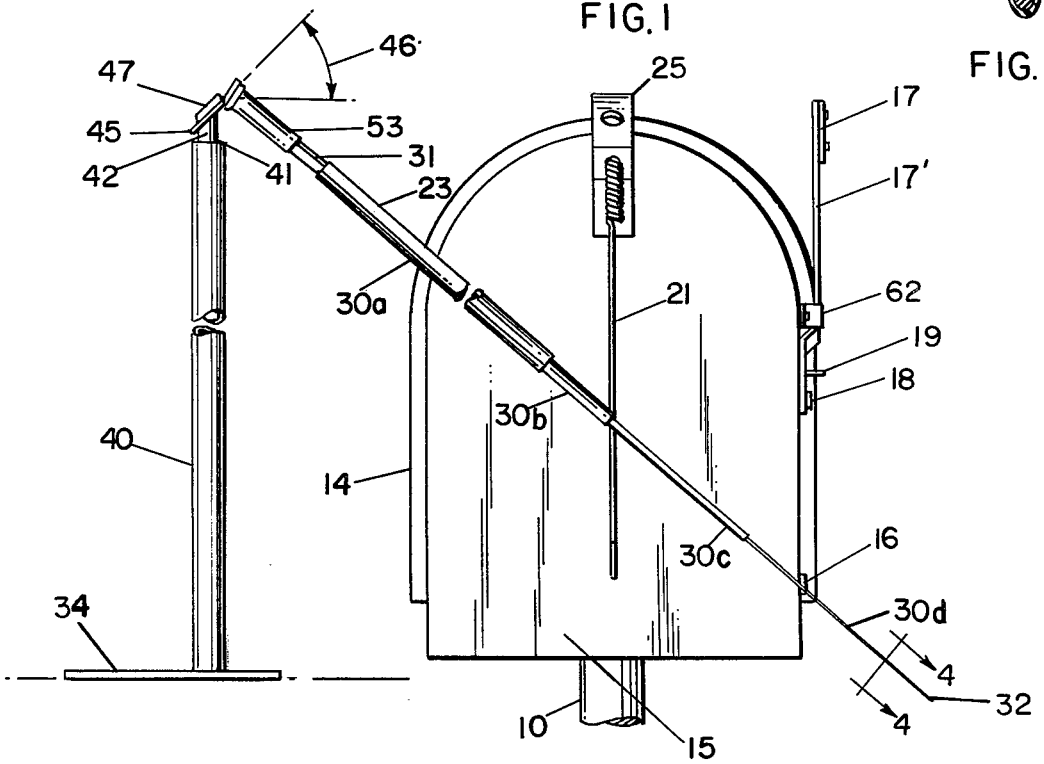
FIG. 2 is a front elevational view of the mailbox and actuating rod shown in FIG. 1.

In accordance with the invention, a torsion spring 20 is positioned on the hinge pin 16, the spring having end portions 20*a* which bear against the underside of the box bottom 13 as shown in FIG. 1, while an intermediate portion 20*b* of the spring bears against the door 15 at a point below the hinge pin. The spring thus biases the door to its closed position. While this spring arrangement is preferred, any other suitable spring may of course be used for the same purpose. As shown in FIG. 5, the end portions 20*a*,20*a* of the torsion spring 20 are each provided with a latching hook 20*a*′ which is adapted to be hooked over one of the legs 20*b*′ of the intermediate portion 20*b* when it is desired to remove the the spring bias from the door 15. Until such time as a decision is made to equip a mail delivery vehicle with automatic mailbox door opening means as will be subsequently described, the mailbox will be served manually without spring bias applied to close the door as is presently conventional. The spring 20 may be activated to bias the door into closed position by unlatching the hooks 20*a*′ from the legs 20*b*′.

In accordance with this invention, a lever arm 21 is mounted on the outside of the door 15 so as to project outwardly and downwardly with respect to the door in the closed position thereof. As hereinafter described, the arm 21 cooperates with an actuating rod 23 which is mounted on a mail service vehicle 24 so as to automatically open the mailbox door as the vehicle approaches the box.

Figure 8:
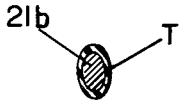
FIG. 8 is an enlarged sectional detail of the flexible lever arm for opening the mailbox door taken on line 8—8 of FIG. 1.

The arm 21 is formed from flexible spring wire and includes a mounting portion 21*a* at one end, an elongated intermediate portion 21*b* extending linearly from the mounting portion and a hooked end portion 20*c* remote from the mounting portion. The mounting portion 21*a* is a tightly wound helical coil spring. The end portion 22 of the mounting portion 21*a* remote from the intermediate portion 21*b* extends through an opening 26 in a latch member 25 which is secured to the door 15 by screws 27. The end portion 22 is formed with an S-shaped end which is adapted to fit around the screws 27 and be clamped between the latch member 25 and the outer surface of the door 15 as shown by dotted lines in FIG. 3. Other means for securing the coiled spring mounting portion 21*a* to the latch member 25, such as by welding the end of the mounting portion to the latch member, may be utilized. At least the elongated intermediate portion 21*b* of the arm 21 has an oval cross section, as seen in FIG. 8, with its major axis in a vertical plane and its minor axis in a horizontal plane so that the arm 21 is more flexible to bend horizontally toward and away from the mailbox than it is to bend vertically. The arm 21 has substantial resistance to bending in a vertical plane so that when the arm is engaged by the actuating rod 23 it will be forced down without substantial bending to open the door 15. The force necessary to bend the arm 21 vertically is therefore substantially greater than the force required to be exerted upon the arm 21 by the rod 23 for opening the door 15. The hooked end portion 21*c* curves upwardly from the intermediate portion 21*b* and is terminated in a spiral. The flexibility of the arm 21 and the spiral ended hook portion 21*c* prevent injury to a person or to an object traveling into the path of the arm 21. The present invention therefore provides safety features which are highly desirable, even if they are not required.

The latch member 25 has a first planar end portion 25*a* by which it is secured to the outside of the door 15, a second planar portion 25*b* inclined upwardly and outwardly from end portion 25*a*, and a third planar portion 25*c* inclined upwardly and inwardly from the second portion 25*b* over the top of the door 15. The free end 25*c*′ of the third portion 25*c* of latch member 25 is bent under in a rounded reverse bend to provide a hook for latching engagement with another latch member, or keeper 28, mounted on top of the mailbox B adjacent the open end 11 of the body 12. The keeper 28 is secured to the top of the mailbox by suitable fastening means 29, such as rivets, screws, or spot welds, and it includes a hooked end portion 28*a* which yieldably engages with the free end portion 25*c*′ of the latch member 25 to hold the door 15 in closed position. The latch including latch member 25 and keeper 28 will release the door 15 when a predetermined outward force is applied to the door arm 21. The third portion 25*c* of latch member 25 is substantially perpendicular to the second portion 25*b* from which the arm 21 projects outwardly and downwardly. The arm 21 is normally substantially parallel to the third portion 25*c*.

The actuating rod 23 includes an elongated downwardly slanted portion 30 having an upper end 31 and a free end 32 at its lower extremity, and mounting means 33 secured to the upper end 31 for positioning the downwardly slanted portion 30 outwardly from the side of the vehicle 24.

The mounting means 33 for the actuating rod 23 includes a substantially flat mounting plate 34 positioned horizontally on the upper ledge 35 of a front fender of a modern postal service vehicle to one side of the vehicle hood 37. The mounting plate 34 is secured on top of the fender by hooks 38 which depend from the inner side edge of the mounting plate and which have pins which engage in holes provided in the downturned flange 36 of the fender 35. A strap 39 is secured to the opposite side edge of the mounting plate 34 and is buckled to the bottom edge of the vehicle fender with a J-shaped hook (not shown). A cylindrical standard 40 is welded to the mounting plate 34 and extends upwardly therefrom substantially perpendicularly to the mounting plate. The upper end of the standard 40 provides a socket 41 for detachably supporting therein a cylindrical rod 42 which provides an upward extension of the standard 40. A pair of vertically aligned holes 43 are provided in the standard 40 for engaging spring pressed detents 44 secured on the rod 42. The detents 44 when pressed into the holes 43 lock the rod 42 in the socket 41, and when the detents are pushed inwardly out of the holes, the rod 42 may be quickly removed from the socket 41. A flat plate 45 is welded to the upper end of the rod 42 and extends laterally from the side of the vehicle substantially perpendicular thereto. The end of rod 42 is cut so that when the plate 45 is welded thereto the plate is inclined at an angle, as indicated at 46, which is approximately 45° from a horizontal plane. A pivot pin 47 extends through a hole in the plate 45 and an aligned hole in one end 49 of a link 48 to provide a first pivoted friction joint connecting the link 48 to the upward extension 42. A second pivot pin 51 extends through the end 50 of the link 48 opposite the end 49 and connects the link 48 with a flattened end 52 of a ferrule 53 to provide a second pivoted friction joint. The mating faces of the flat ends of link 48 and of the plate 45 and flat end 52 of ferrule 53 respectively are suitably roughened so that the first and second pivoted friction joints are designed to remain in a fixed position until an excessive force is applied to overcome the friction forces and permit the joints to yield. The upper portion 31 of the downwardly slanted rod 30 is removably held in the open end of the quick disconnect ferrule 53. This permits the rod 30 to be removed from the mounting means 33. If it is desired to remove both the rod 30 and link 48 from the vehicle, the upper extension 42 may be removed from the standard 40 by depressing the detent pins 44. Finally, if the whole system including the actuating rod 23 and mounting means 33 is to be removed, the mounting plate 34 is removed from the vehicle by opening the hood 37, loosening the strap 39 and disengaging the plate pins 38 from fender holes. The rod 30 is designed to telescope in order to shorten same while not in use in the manner of an automobile radio antenna.

The sections of the downwardly slanted rod 30 are oval in cross section with a major axis in a vertical plane and a minor axis in a horizontal plane so that the rod is more flexible to bend horizontally toward and away from the mailbox B than it is to bend vertically. Both the rod 23 and the lever arm 21 are preferably coated with a low friction material T such as Teflon.

The signal flag 17 and the door 15 of the mailbox B may be operated independently of each other. Only in the case that the flag 17 is in the up position and the door is being opened will both door and flag operate simultaneously. The pivot pin 18 is a rivet by which the flag 17 is pivotally supported on the side of the mailbox B. The rivet 18 has a square sectioned shank 18' which extends first, through a square hole 54 in the lower end of the flag support standard 17'; second, through a square hole **55*a* in a round spacer 55 which fits in the round hole 56 in the side of the mailbox; thirdly, through a spring pawl 57; fourthly, through a pawl keeper washer 58; and finally, through a square hole in a rivet head washer 60. The end of the rivet 18 is upset beyond the rivet head washer to hold the flag and pawl assembly together. The square hole washer-spacer 55 has a thickness which is greater than the thickness of the mailbox wall 12 so as to allow a free rotational fit between the flag assembly and the box. The pawl keeper 58 is symetrically fabricated with four tangs 58*a* and a square-center hole. The tangs of the pawl keeper 58 fit over the split end portions of the spring pawl 57 and hold the ends firmly against the square shank 18'. A cover plate 61 having an inwardly offset portion 61' is secured inside the mailbox to prevent mail from coming in contact with the flag pawl 57** which would cause restricted movement of the pawl.

The spring pawl 57 is preferably formed from spring wire having a coiled intermediate portion **57*a*, a pair of legs 57*b*,57*b* extending from opposite ends of the coil 57*a* toward the rivet 18 and right angled end portions 57*c* on each of the legs 57*b*. The right angled end portions 57*c* of the legs 57*b* face in opposite directions and together form a split square adapted to fit the square rivet shank 18'. The end portions 57*c* are held securely against the square shank 18' by the four tangs of the pawl keeper 58. A loop 57*d* of one or more coils is provided in each of the legs 57*b***.

In accordance with the usual custom of rural mailbox owners, when a letter to be mailed is placed in the mailbox B to be picked up by the postal service, the person placing the letter in the box raises the flag 17 to an upstanding position as shown in FIG. 1 where it comes against the up position stop 62. When the flag 17 is raised, the pawl 57 is swung down to a position where it extends outwardly toward the open end 11, and the coiled intermediate portions **57*a* projects slightly beyond the open end so that when the door 15 is raised to a closed position the coil 57*a* fits in the outwardly deformed dimple 15*a*. With the door closed, the dimple 15*a* holds the pawl 57 therein and the flag is held in the raised position. When the door 15 is opened, the pawl 57 is released and the flag 17 falls by gravity to a lowered position against the stop 19. The center of gravity of the flag 17 in the raised position is offset clockwise from a vertical position so that the flag will fall under its own weight when the pawl 57 is released from engagement with the dimple 15*a***.

The pawl 57 is made of spring material and is designed for the purpose of permitting manual operation of the flag 17 to raised or lowered position with the door 15 closed. When the flag 17 is being raised and the door 15 is closed, the pawl 57 swings down in a counterclockwise direction until it hits the inside of the door 15. The pawl will then yield, shortening in length sufficiently to enter the dimple **15*a*, whereupon the elasticity of the pawl extends the pawl fully into the dimple 15*a* where it is securely held. When an operator wishes to lower the flag 17 from its raised position, without opening the door 15, it is merely necessary to grasp the flag and rotate it clockwise to the lowered position. In rotating the flag 17 clockwise, sufficient force is required to cause the pawl to yield and to shorten lengthwise until it escapes from the dimple 15*a* in the door whereupon the flag is free to fall under its own weight to the lowered position against the stop 19. The loops or coils 57*d* in the legs 57*b* permit the pawl 57 to contract lengthwise without any deformation of the arms 57*b* between the coils 57*d* and the shaft 18'. The ease in yielding is thereby a function of the number of turns in the coils 57*d*, their diameter, and the size of the spring wire. The coiled intermediate portion 57*a* of the pawl spring wire forms the free end of the pawl which contacts the door 15. The diameter of the coiled end 57*a* determines how well the flag 17 seeks the same orientation each time it is raised to the upright position. The number of turns of the coil 57*a* determine the surface contact area of the pawl 57 with the door 15 for wear purposes. The flag 17 and its associated parts as shown in FIG. 7 permit the flag to be operated easily even in freezing weather and ice condition. For weather purposes, the mechanical contact of the pawl 57 with the door 15** is inside the mailbox B. If the flag becomes iced, it can be pushed manually to the down position.

A weather weep hole with a downwardly open cover 63 is provided in the side of the mailbox below the pivot 18 of the signal flag to permit drainage of any rain water which might enter the box.

While the invention has been described in detail for the purpose of illustration, it will be obvious that numerous modifications and variations may be resorted to within the spirit and scope of the invention without departing from the claims.

What is claimed is:

1. For use in combination with a mail service vehicle, a roadside mailbox especially adapted to be opened and closed by movement of the vehicle past the mailbox, said mailbox including a hollow body having an open end for facing said roadside, a roadfacing door for closing said open end swingable between a closed and an open position, hinge means for mounting said door adjacent the open end of said hollow body, said hinge means having a horizontal axis about which said door swings, means biasing said door to its closed position, and an arm secured to and projecting outwardly from said door to provide a lever arm for swinging said door open, said arm having a mounting portion secured to said door, an intermediate portion extending from said mounting portion, and a hooked end portion remote from said mounting portion, said hooked end portion being curved upwardly from said intermediate portion, said arm being formed from flexible spring wire and having greater flexibility to bend horizontally than vertically, said arm having substantial resistance to bending in a vertical plane, together with a slanted actuating rod adapted to be mounted on a vehicle and engageable with said arm to open said door against the action of said biasing means as the vehicle approaches the mailbox, said actuating rod including an elongated downwardly slanted portion having an upper end and a free end at its lower extremity, and mounting means secured to the upper end of said downwardly slanted portion for positioning said downwardly slanted portion outwardly from the side of said vehicle in position for the downwardly slanted portion to engage said arm intermediate the ends of said downwardly slanted portion in order to cam said arm downwardly to open said door as the vehicle moves along the roadside adjacent said mailbox.

2. The arrangement as defined in claim 1 wherein the intermediate portion of said arm has an oval cross section with its major axis in a vertical plane and its minor axis in a horizontal plane.

3. The arrangement as defined in claim 1 wherein the mounting portion of said arm is formed into a coil spring.

4. The arrangement as defined in claim 1 together with latch means for securing said door in closed position, said latch means including a first latch member mounted on top of said hollow body adjacent said open end, and a second latch member mounted on said door for yieldingly engaging said first latch member when said door is swung to its closed position, and for yieldingly retaining said door in closed position, said second latch portion having one end portion secured on the outside of said door, a second portion inclined upwardly and outwardly from said one end portion, a third portion inclined upwardly and inwardly from said second portion over the top of said door and terminating in a free end portion positioned to engage said first latch member, said mounting portion of said arm being secured to said second portion of said second latch member.

5. The arrangement as defined in claim 4 wherein said mounting portion of said arm is formed into a coil spring and said intermediate portion extends linearly from said mounting portion.

6. The arrangement as defined in claim 1 wherein said hooked end portion of said arm terminates in a spiral.

7. The arrangement as defined in claim 1 wherein said door biasing means includes means for deactivating said biasing means to remove bias from said door.

8. The arrangement as defined in claim 1 wherein elongated downwardly slanted portion of said actuating rod includes telescoping sections.

9. The arrangement as defined in claim 1 wherein the mounting means secured to the upper end of said actuating rod includes a mounting plate, means for detachably securing said mounting plate on the side of said vehicle, a standard extending upwardly from said mounting plate and having a socket at its upper end, an upward extension of said standard detachably secured in said socket, a link, a first pivoted friction joint means connecting one end of said link to said upward extension, a second pivoted friction joint means connecting the other end of said link to the upper end of said downwardly slanting portion of said actuating rod, said first pivoted friction joint means yieldably supporting said link to extend outwardly from the side of said vehicle in a predetermined position while permitting said link to swing relative to said upward extension when a predetermined force which said first pivoted friction joint means is designed to resist is exceeded, said second pivoted friction joint means yieldingly supporting said downwardly slanting portion of said actuating arm in said downwardly slanting position while permitting said downwardly slanting portion to swing relative to said link when a predetermined force which said second pivoted friction joint means is designed to resist is exceeded.

10. The arrangement as defined in claim 9 wherein said first pivoted friction joint means permits said link to swing in a plane inclined approximately 45 degrees to the horizontal.

11. The arrangement as defined in claim 9 wherein said second pivoted friction joint means includes a ferrule pivoted to said link, said ferrule having an open socket for detachably securing the upper end of said downwardly slanted portion of said actuating rod therein.

12. The arrangement as defind in claim 1 wherein said actuating rod is flexible and at least said downwardly slanted portion of said actuating rod has an oval cross section with its major axis in a vertical plane and its minor axis in a horizontal plane so that the rod is more flexible to bend horizontally toward and away from said mailbox than it is to bend vertically.

13. The arrangement according to claim 1 wherein said hollow body of said mailbox includes an elongated bottom floor and an elongated cover portion of inverted U-shaped cross section secured to said bottom floor, said hinge means including a hinge pin mounted transversely beneath said floor adjacent said open end.

14. The arrangement as defined in claim 1 together with a signal flag pivotally mounted on one side of the mailbox for movement between a raised and a lowered position and pawl means operatively connecting said door to said flag so that the flag, when raised, is lowered by opening of the door.

15. The arrangement as defined in claim 14 wherein said pawl means is confined within said mailbox.

16. The arrangement as defined in claim 14 wherein said door includes a surface portion engageable with said pawl means when said door is closed for holding said flag upright, said surface portion releasing said pawl means when said door is opened and permitting said flag to fall by gravity to its lowered position.

17. The combination of a mailbox including a hollow body having an open end for facing a roadside, a door for closing said open end swingable between a closed and open position, hinge means for mounting said door adjacent the open end of said hollow body, said hinge means having a horizontal axis about which said door swings, a signal flag pivotally mounted on one side of the mailbox between a raised and lowered position, pivot means for said signal flag having a shank projecting into the hollow body of said box, an elongated spring pawl secured on said shank inside of said box and projecting radially from said shank, said door having means thereon for engaging and releasably holding said pawl when the flag is in raised position and said door is closed, said flag being inclined to fall under its own weight to a lowered position when said door is opened, said spring pawl being longitudinally yieldable upon the manual application of a predetermined rotative force to said signal flag toward its lowered position to cause said pawl to disengage said pawl holding means on said door when the door is in closed position and thereby to permit said flag to fall by gravity to its lowered position.

18. The combination of claim 17 together with a shield for said pawl to prevent mail inside said box from encountering said pawl.

* * * * *